US006708642B1

(12) United States Patent
Taylor

(10) Patent No.: US 6,708,642 B1
(45) Date of Patent: Mar. 23, 2004

(54) TRI-SPONSON BOAT HULL AND METHOD OF MAKING BOAT HULLS

(75) Inventor: Ian A. Taylor, Hamilton (CA)

(73) Assignee: Reflex Advanced Marine Corp., Burlington (CA)

( * ) Notice: Subject to any disclaimer, the term of this patent is extended or adjusted under 35 U.S.C. 154(b) by 0 days.

(21) Appl. No.: 10/081,758

(22) Filed: Feb. 22, 2002

(51) Int. Cl.[7] ..... B63B 1/32
(52) U.S. Cl. ..... 114/290; 114/291
(58) Field of Search ..... 114/61.1, 272, 114/274, 277, 288, 290, 291, 357

(56) References Cited

U.S. PATENT DOCUMENTS

| | | | | |
|---|---|---|---|---|
| 3,208,421 A | * | 9/1965 | Landes et al. | 114/290 |
| D219,795 S | | 1/1971 | Field | |
| 4,004,534 A | | 1/1977 | Allison | |
| D244,841 S | | 6/1977 | Nescher | |
| 4,091,761 A | | 5/1978 | Fehn | |
| 4,231,314 A | | 11/1980 | Peters | |
| 4,348,972 A | | 9/1982 | Parsons | |
| D307,574 S | | 5/1990 | Pipkorn | |
| 4,989,534 A | | 2/1991 | Field | |
| 5,167,876 A | * | 12/1992 | Lem et al. | 252/602 |
| 5,211,126 A | | 5/1993 | Johnson | |
| D336,887 S | | 6/1993 | Granie et al. | |
| 5,265,554 A | | 11/1993 | Meredith | |
| 5,415,120 A | | 5/1995 | Burg | |
| 5,435,260 A | | 7/1995 | Granie et al. | |
| 5,526,762 A | | 6/1996 | Kiley | |
| 5,655,473 A | | 8/1997 | Arvilla | |
| D400,156 S | | 10/1998 | Duvenage et al. | |
| 5,837,185 A | | 11/1998 | Livesay et al. | |
| 5,850,793 A | | 12/1998 | Bronson | |
| 5,875,732 A | | 3/1999 | Chapman et al. | |
| 6,067,923 A | | 5/2000 | Ratlieff, Jr. | |
| 6,462,126 B1 | * | 10/2002 | Gosiewski et al. | 524/560 |

FOREIGN PATENT DOCUMENTS

| | | |
|---|---|---|
| CA | 1044533 | 12/1978 |
| DE | 199 56 760 C1 | 5/2001 |
| FR | 2 687 362 A1 | 8/1993 |
| RU | 2 108 259 C1 | 4/1998 |
| WO | WO 00/07874 A1 | 2/2000 |

OTHER PUBLICATIONS

U.S. Copyright Registration No. DVH 0007, Registered Jan. 7, 2000.
U.S. Copyright Registration No. DVH 0008, Jan 7, 2000.
U.S. Copyright Registration No. DVH0048, Registered Feb. 8, 2001.
Stafl, Laurène, PCT, Invitation To Pay Additional Fees (Form PCT/ISA/206), Jul. 10, 2003.

* cited by examiner

*Primary Examiner*—Stephen Avila
(74) *Attorney, Agent, or Firm*—Hodgson Russ LLP

(57) ABSTRACT

A boat hull having an upper hull section, a pair of spaced apart substantially parallel elongated outer sponsons extending from a forward portion to a stern portion of a bottom of the upper hull section, the outer sponsons and upper hull section defining a tunnel therebetween; and an elongated center sponson extending along the bottom of the upper hull and positioned in the tunnel between and substantially parallel to the pair of outer sponsons and having a forward section with an upwardly extending trailing step wall defining an upward step in the center sponson, and an aft section that is located aft of the forward section, the aft section having an upwardly curved leading edge intersecting the step wall of the forward section. The upper hull section can have planar bottom.

28 Claims, 9 Drawing Sheets

TRI-SPONSON BOAT HULL AND METHOD OF MAKING BOAT HULLS

BACKGROUND OF THE INVENTION

The present invention is directed towards boat hulls, and in particular boat hulls having three sponsons.

Tunnel hull boat structures having a pair of longitudinal side channels that define a central tunnel in which is located a central sponson are known. Such boat hulls are typically configured so that the outer sponsons and central sponsons collectively sit in the water at low speed, however at higher planing speeds, the boat hull is partially supported by the surfaces of the side sponsons planing on the water and partially by air being compressed between the inside surfaces of the outer sponsons, the tunnel roof and the water surface.

Conventional tri-sponson boat design lacks versatility in that the designs are generally intended to be used in smaller pleasure-boat type applications and do not lend themselves well to being scaled to larger boats. Conventional designs also tend to lack versatility in that while a particular design maybe suitable for use in a specific environments, the same design may not be suitable for use in other environments. For example, a tri-sponson boat structure which may be quite efficient in smooth water conditions may not be suitable for rougher waters and a tri-sponson design intended for rougher waters may be inefficient in smoother waters.

Accordingly, there is a need for a tri-sponson boat hull that is scalable, and which can provide a smooth, efficient ride over a range of speeds and water conditions. There is also a need for an efficient method for manufacturing such a boat hull.

SUMMARY OF THE INVENTION

According to one aspect of the present invention there is provided a boat hull that includes an upper hull section, a pair of spaced apart substantially parallel elongated outer sponsons extending from a forward portion to a stern portion of a bottom of the upper hull section, the outer sponsons and upper hull section defining a tunnel therebetween, and an elongated center sponson extending along the bottom of the upper hull and positioned in the tunnel between and substantially parallel to the pair of outer sponsons and having a forward section with an upwardly extending trailing step wall defining an upward step in the center sponson, and an aft section that is located aft of the forward section, the aft section having an upwardly curved leading edge intersecting the step wall of the forward section.

According to another aspect of the invention, there is provided a boat hull that includes an upper hull section, a pair of spaced apart substantially parallel elongated outer sponsons extending from a forward portion to a stern portion of a bottom of the upper hull section, the outer sponsons and upper hull section defining a tunnel therebetween, the outer sponsons each having an inner wall extending substantially perpendicular to a water line, an outer chine and a bottom wall joining, bottom edges of the inner wall and the outer chine, the bottom wall being substantially planar aft of a leading edge thereof and angled upwardly from the inner wall to the outer chine, the upward angle of the bottom wall relative to the water line being less than that of the outer chine, and an elongated center sponson extending along the bottom of the upper hull and positioned in the tunnel between and substantially parallel to the pair of outer sponsons, the center sponson extending forwardly of the outer sponsons and having a upward step along its length with a portion of the center sponson leading the step having a greater depth than a portion of the center portion aft of the step, the center sponson being of lesser depth than the outer sponsons.

According to another aspect of the invention, there is provided a boat hull that includes an upper hull section having a substantially planar underbody, a pair of spaced apart substantially parallel elongated outer sponsons extending from a forward portion to a stern portion of the underbody of the upper hull section, the outer sponsons and underbody defining a tunnel therebetween, and an elongated center sponson extending along the underbody and positioned in the tunnel between and substantially parallel to the pair of outer sponsons.

According to still another aspect of the invention, there is provided a boat hull having an upper hull section, a pair of spaced apart substantially parallel elongated outer sponsons extending from a forward portion to a stern portion of a bottom of the upper hull section, the outer sponsons and upper hull section defining a tunnel therebetween, and an elongated center sponson extending along the bottom of the upper hull section and positioned in the tunnel between and substantially parallel to the pair of outer sponsons, the center sponson extending further forward and aft-ward than the outer sponsons.

According to yet another aspect of the invention, there is provided a boat hull having a bow and a stern, the hull comprising an upper hull section, a pair of spaced apart substantially parallel elongated outer sponsons extending from a forward portion to a stern portion of a bottom of the upper hull section, the outer sponsons and upper hull section defining a tunnel therebetween, an elongated center sponson extending along the bottom of the upper hull section and positioned in the tunnel between and substantially parallel to the pair of outer sponsons, and a wing-shaped lift spoiler pivotally mounted between the pair of outer sponsons, the spoiler passing beneath an aft section of the center sponson and being adjustable to control trim of the boat hull during use.

According to another aspect of the invention there is provided a method of making a tri-sponson boat hull, including steps of (a) forming from reinforced fibre material, using an upper hull mold, an upper hull section having a substantially planar underbody; (b) forming from reinforced fibre material, using first and second outer sponson molds, an elongated first outer sponson and an elongated second outer sponson; (c) forming from reinforced fibre material, using a center sponson mold, an elongated center sponson; (d) arranging the upper hull section, first and second outer sponsons and the center sponson such that the first and second outer sponsons extend from a forward section to a stern portion of the underbody of the upper hull section, the outer sponsons and underbody defining a tunnel therebetween, and the center sponson extends along the underbody of the upper hull and is positioned in the tunnel between and substantially parallel to the first and second outer sponsons; and (e) securing the outer sponsons and center sponson to the upper hull using reinforced fibre material.

According to yet another aspect of the invention there is provided a method of making a boat hull that includes steps of layering up on a boat hull mold blended Kevlar (T™) and E-glass woven fabrics that are pre-impregnated with heat curable epoxy resin, and heat curing the layered fabrics.

Various other features of the present invention will be apparent from a consideration of the accompanying specification, claims and drawings.

BRIEF DESCRIPTION OF THE DRAWINGS

Like numerals are used throughout the drawings to refer to like components, in which.

DETAILED DESCRIPTION OF THE PREFERRED EMBODIMENTS

Figure 1:
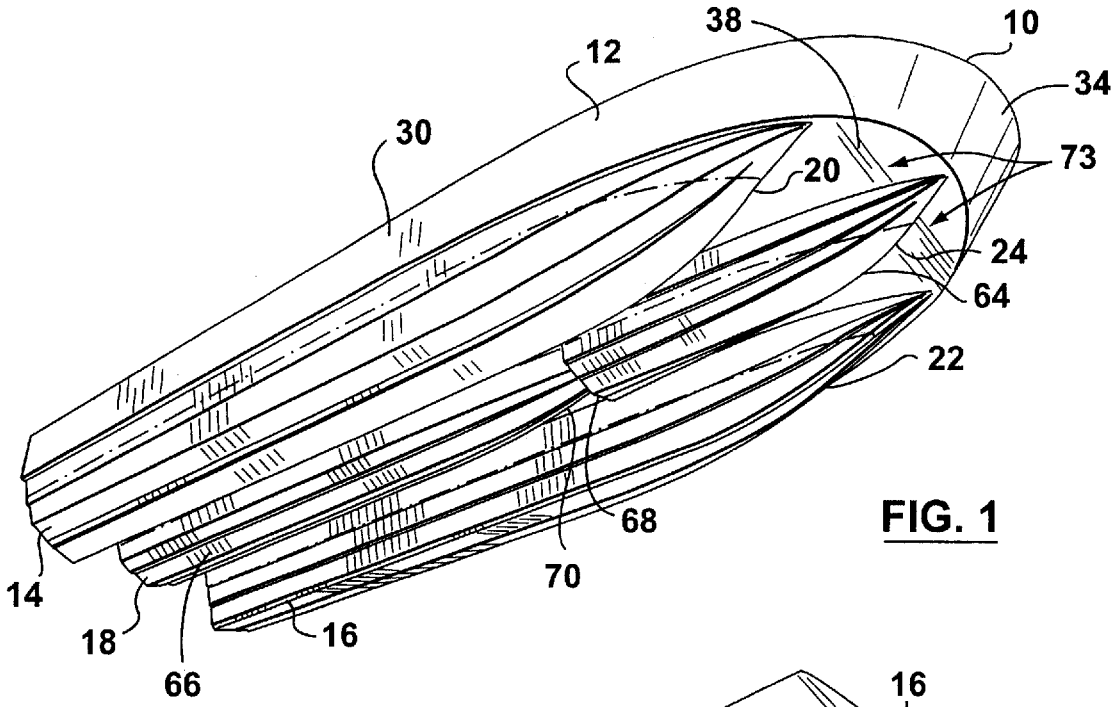
FIG. 1 is a perspective view from the bottom showing a boat hull according to a preferred embodiment of the invention.
Figure 2:
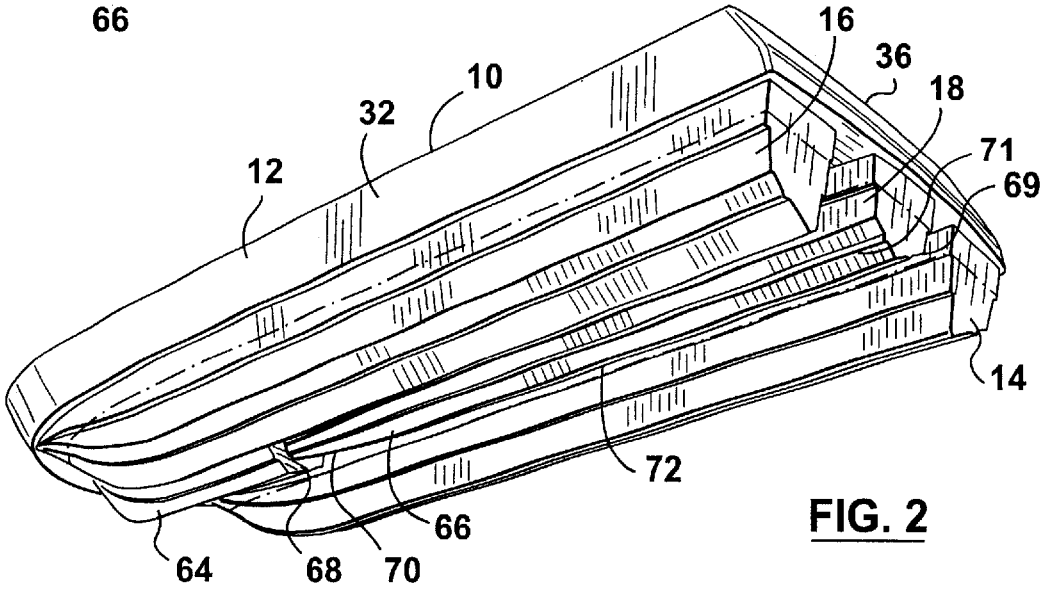
FIG. 2 is a further perspective view from the bottom of the boat hull of FIG. 1.
Figure 3:
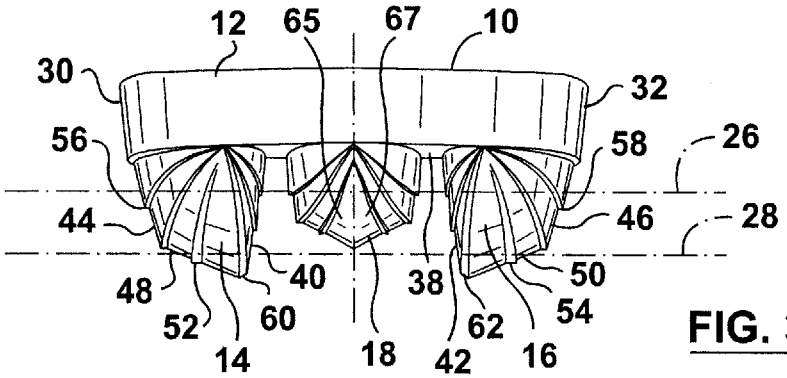
FIG. 3 is a front elevation view of the boat hull of FIG. 1.

With reference to FIGS. 1–3, a boat hull 10 according to one preferred embodiment of the present invention includes an upper hull section 12 and a pair of spaced apart outer sponsons 14, 16 extending along a bottom of the boat hull such that a tunnel 73 is defined by the bottom of the upper hull section 12 and the pair of outer sponsons 14, 16. A central sponson 18 extends along the bottom of the upper hull section 12 and is positioned in the tunnel area between the pair of outer sponsons 14, 16. The outer sponsons 14, 16 and the inner sponson 18 each have a respective upwardly curved leading edge 20, 22 and 24. The leading edge 24 of the centre sponson 18 extends forwardly of the leading edges 20, 22 of the pair of outer sponsons 14, 16. The centre sponson 18 may, in a prefered embodiment, also extend further aft than the sternward ends of outer sponsons 14, 16, which is convenient if a drive system is to be included in the centre sponson 18.

As shown in FIG. 3, the maximum depth of the centre sponson 18 is less than that of the outer sponsons 14, 16. The boat hull 10 is arranged such that at rest and at lower speeds all three sponsons 14, 16 and 18 will typically sit in the water, whereas at higher speeds, under normal loading, the boat hull 10 will plane along on aft portions the outer sponsons 14, 16 with the centre sponson 18 positioned above the water. In this regard, line 26 in FIG. 3 shows an exemplary water line when the boat hull is at rest or at low speed, and line 28 illustrates an exemplary water line when the boat hull 10 is planing at high speed.

The components of the boat hull 10 will now be described in greater detail. In a preferred embodiment, the upper hull section 12 has a substantially planar bottom or underbody 38 along which the sponsons 20, 22 and 24 are positioned. Upper hull side walls 30, 32 extend upwardly from the starboard and port side peripheral edges of the underbody 38. A curved bow portion 34 extends upwardly from a semi-circular front peripheral edge of the underbody 38 between the side walls 30, 32. An upwardly extending transom wall 36 is located between the aft ends of the upper hull sidewalls 30, 32 along an aft peripheral edge of the underbody 38.

The outer sponsons 14 and 16 are substantially identical, being mirror images of each other when viewed from the front of the hull. Each outer sponson 14, 16 has an inner side wall 40, 42, an outer chine 44, 46, and a bottom wall 48, 50. Preferably, the inner side walls 40, 42 of the outer sponsons 14, 16 are substantially planar walls that form a perpendicular, or just slightly less than perpendicular, angle with the water line. The substantially planar bottom walls 48, 50, are preferably upwardly angled from the inner sidewalls 40, 42 to the outer chines 40, 46. The substantially planar outer chines 44, 46 extend at a higher dead rise angle than the bottom walls 48, 50, but are not as sharply-angled relative to the water line as the inner walls 40, 42. The leading edge portion 20, 22 of each outer sponson has a higher dead rise angles than the remaining aft portion of the sponson. The sponsons 14 and 16 are generally of a uniform depth along their respective lengths aft of the leading edges 20, 22 thereof such that the bottom surface of the underbody 38 lies in a plane that is parallel with the keelson of the outer sponsons 14, 16. An intermediate longitudinal spray rail 52, 54 may be located along the bottom wall 48, 50 of each sponson 14, 16. Similarly, a longitudinal spay rail may be provided along the outer chine 44, 46 of each of the outer sponsons 14, 16. Longitudinal spray rails may also be located on the inner walls 40, 42.

The outer sponsons are preferably configured such that the bottom wall 48 and outer chine 44 of the outer sponson 14 form one half of a V-shape, and the bottom wall 50 and outer chine 46 of the other sponson 16 form the other half of a V-shape, such that if the two outer sponsons were joined along the bottom edge of bottom walls 48 and 50, the combined hulls would have a shape similar to that of a conventional V-shaped boat hull. Such a configuration can assist in improving the maneuverability of the hull 10.

Figure 4:
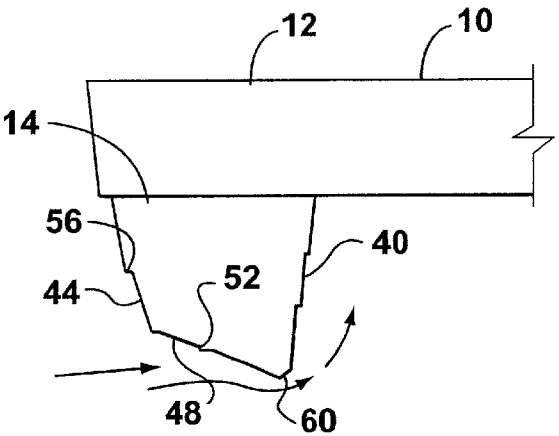
FIG. 4 is a partial sectional view of the boat hull showing one of the outer sponsons.

As can be seen in FIG. 3, in a preferred embodiment, the corner 60, 62 where the bottom wall 48, 50 of each outer sponson 14, 16 joins with its corresponding inner wall 40, 42 is inwardly upward angled. In this regard, the small corner portion 60, 62 of each sponson 14, 16 is angled in the opposite direction than the bottom wall 48, 50. FIG. 4 shows the corner 60 of the outer sponson 14 in greater detail (corner 62 having the same configuration). In one preferred embodiment, the corner 60 is inwardly upwardly angled at approximately 45° relative to the plane of the water line. The inwardly upward chamfer of corners 60, 62 allow the boat hull to slide out on a high-speed turn with more ease than a 90° edge would typically permit.

As can be seen in FIGS. 1 and 2, the center sponson 18 includes a leading forward section 64 and a trailing aft section 66 that are joined at an intermediate upward step. The forward section 64 includes an upwardly curved leading edge 24, terminates at an upwardly extending trailing step wall 68, and has two sidewalls 65 and 67 that join at a common bottom edge and diverge in a upwardly direction such that the forward section has a generally V-shaped cross-section along its length.

The aft section 66 of the centre sponson 18 is formed from two elongated side walls 69 and 71 that join at a common bottom edge or keelson 72 and diverge in an upwardly direction such that the aft section 66 has a generally V-shaped cross-section along its length. At the forward end of the aft section 66, the side walls 69 and 71 converge closer together and have a common upwardly curved leading edge that defines a forwardly tapering portion 70 that intersects with the step wall 68. Thus, the leading portion 70 of the aft section 66 tapers in the forward direction much like a mini bow, and becomes deeper aft. The keelson 72 located aft of the leading portion 70 is substantially parallel to the plane of the bottom of the upper hull section 12.

Figure 5:
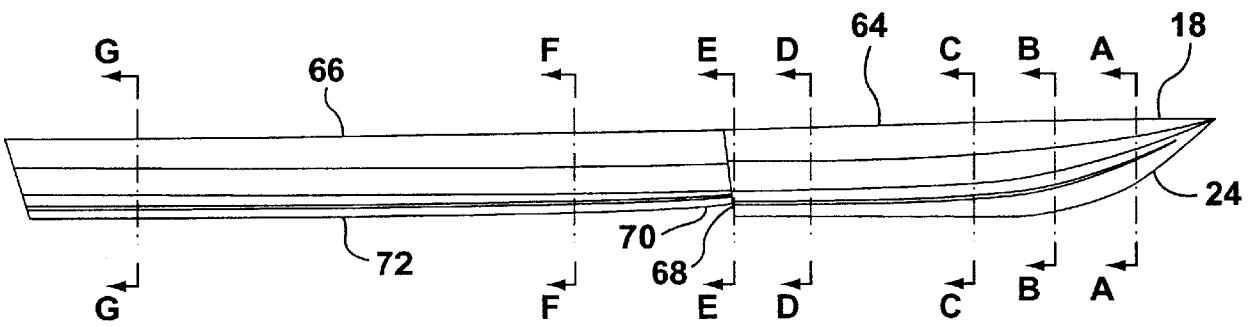
FIG. 5 is a side elevation of the centre sponson of the boat hull.
Figure 6:
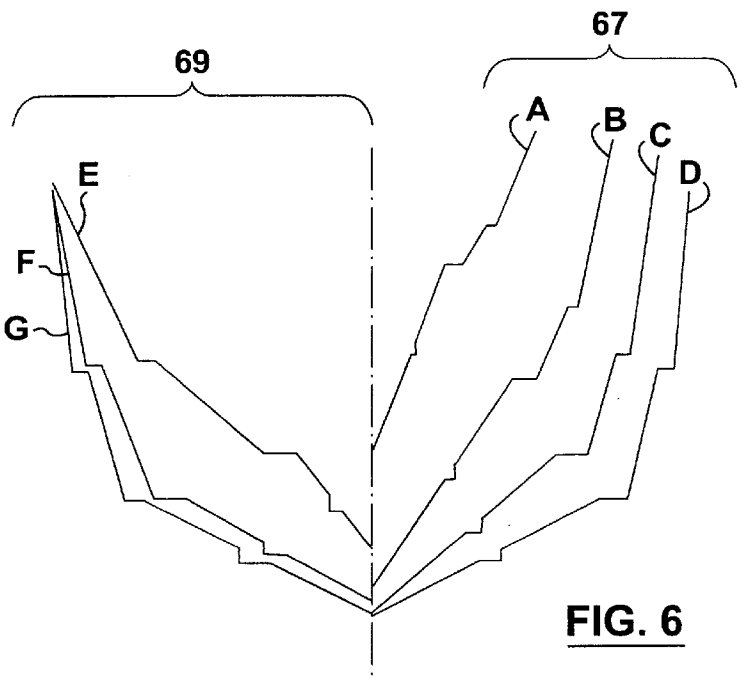
FIG. 6 is a drawing representing sectional views of the centre sponson, taken along the lines A—A to G—G of FIG. 5.

With reference to FIGS. 5 and 6, a preferred configuration of the centre sponson 18 will be explained in greater detail. FIG. 6 provides in diagrammatic form half sectional views of the forward section side 67 and the aft section side 69 taken along the lines A—A to G—G of FIG. 5 of the centre sponson 18. As indicated by lines A–D in FIG. 6, the depth of the forward section 64 of the centre sponson 18 increases at a relatively quick rate moving aft from the leading edge 24, after which the depth of the forward section 64 remains relatively constant until the forward section terminates at step wall 68. The dead rise of the forward section 64 becomes shallower moving aft from the leading edge 24 to the step wall 68. The forward section 64 reaches its deepest point just forward of the step wall 68 at approximately one third of the length of the center sponson back from its most forward point.

Figure 7:
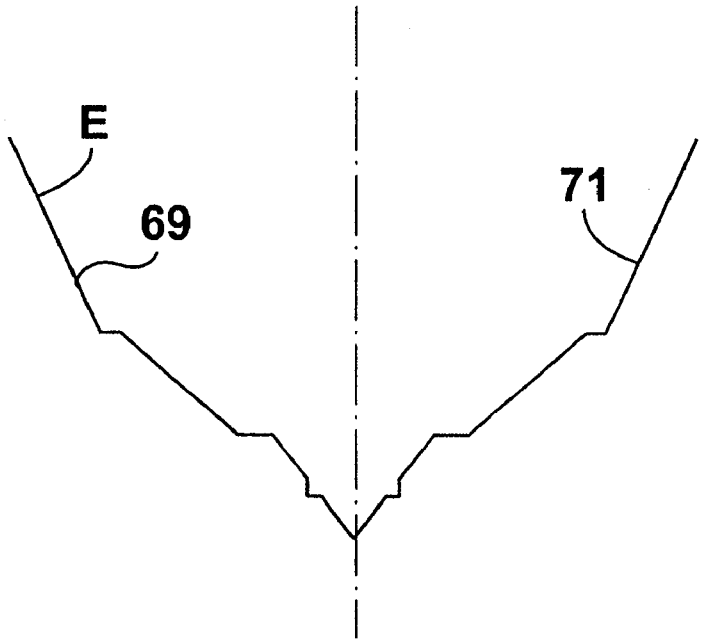
FIG. 7 is a diagrammatic sectional view along the lines E—E of FIG. 5.
Figure 8:
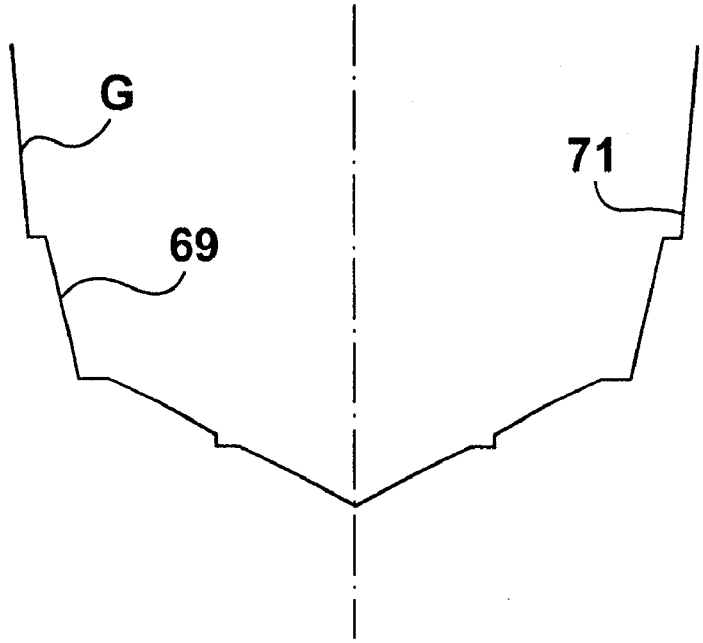
FIG. 8 is a diagrammatic sectional view along the lines G—G of FIG. 5.

As can be appreciated from FIG. 6, the forward end 70 of the aft section has a dead rise angle that becomes shallower in the sternward direction, which is further exemplified in FIG. 7, which indicates by line E the dead rise of the aft section 66 right at the point where forward end 70 terminates at the step wall 68, and FIG. 8 in which line G illustrates the shallower dead rise at a point trailing the leading edge 70 at which the aft section has reached a substantially uniform depth.

The configuration of the center sponson 18 is such that the forward section 64 (which is approximately one third the length of the centre sponson) acts as a wave breaker with the aft section 66 (approximately two thirds of the centre sponson) acting as a ride maker. In particular, the forward section 64 has very steep dead rise angles swelling to a large volume buoyancy body further aft. The forward section 64 is used to break or piece waves in heavy seas and yet, because of its large volume aft, creates a large amount of buoyancy. In this respect, the centre sponson 18 compliments the outer sponsons 14, 16, which have relatively sharp dead rise angles and will cut through waves with ease. However, in heavy seas or large waves, the sharp forward sections of the outer sponsons 14,16 alone are not sufficient to generate buoyancy quick enough and thus the large volume buoyancy body provided by the forward section 64 of the centre sponson 18 combats the tendency that the hull would otherwise have to "stuff" (dive into another wave) or "pitch-pole" (roll end over end) when hitting large waves.

The forwardly tapering front end of the aft section 66 is much like a secondary bow and helps to channel the water coming around the forward section 64 and also helps to dissipate energy when the boat hull falls back into the water after riding over a wave, contributing to a smoother ride. The dead rise angle on the aft section 66 is relatively shallow aft of the leading portion 70, providing good positive buoyancy which aids in softening the fall from waves by parting the water and channeling it towards the outer sponsons. In particular, the aft section 66 of the centre hull assists in creating a softer landing from a large wave by adding its buoyancy quickly and by dividing the large area between the outer sponsons into two smaller tunnels 74, 76 and partially trapping the air passing through such smaller tunnels 74, 76.

Figure 9:
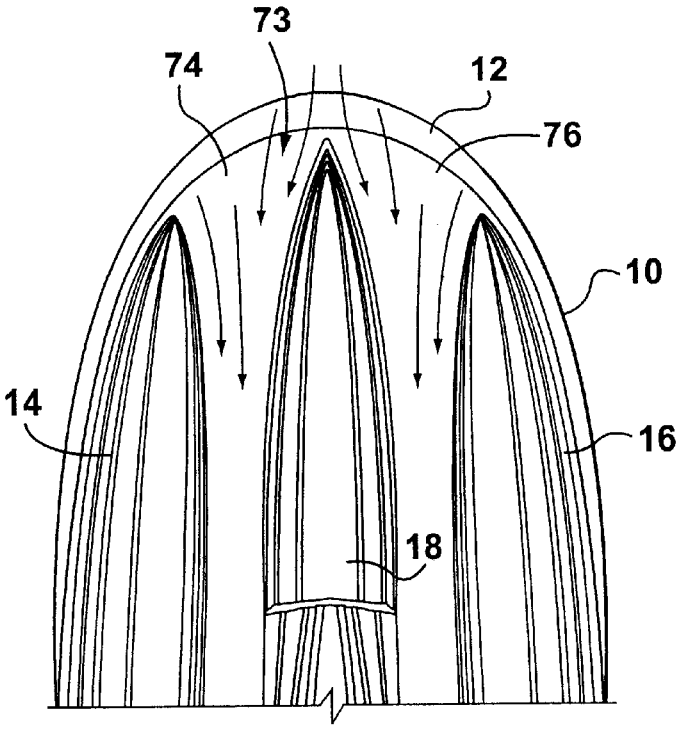
FIG. 9 is a partial bottom plan view of the boat hull showing a forward end thereof.
Figure 10:
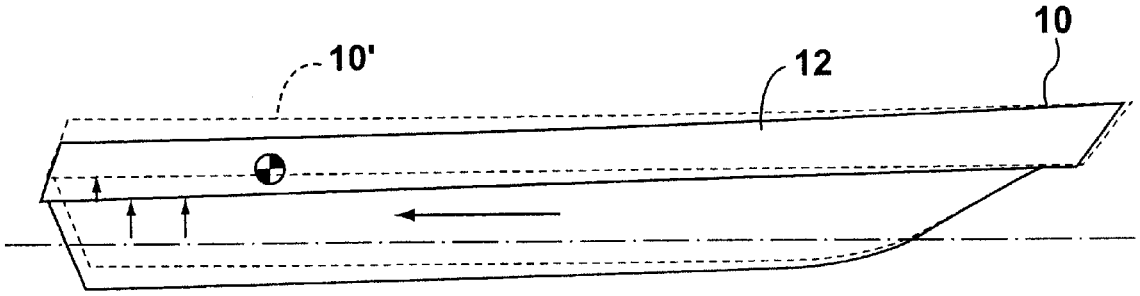
FIG. 10 is a side elevation showing the relative positions of the boat hull and low speed and at a planing speed.

Referring to FIG. 9, the configuration of the outer sponsons 14, 16 and centre sponson 18 is such that the tunnel 73 formed between the outer sponsons 14 and 16 is essentially divided into two smaller tunnels 74, 76 by the centre sponson 18. The tunnels 74 and 76 are provided with funnel-shaped forward ends that are designed to capture and channel frontal air into each channel 74 and 76. FIG. 10 shows the boat hull 10 in a resting or low speed position 10 and in phantom lines as indicated by 10' in a high speed planing position. At slow speed or when the craft is very heavily loaded all three sponsons are in contact with and are displacing water creating a very stable (almost barge-like) platform. At high speeds the boat hull runs on only the two aft sections of the outer sponsons 14, 16.

In particular, at lower speeds, the aft end of the hull will generally be located deeper in the water than the forward end. As the boat hull speeds up, the air passing through the tunnel 74, 76 towards and into the aft sections is gradually compressed by the fact that the crafts altitude is lower aft and thus the roofs of tunnels 74, 76 are lower to the water. As the boat hull speed increases the compressed air lifts the aft sections of the vessel to escape, and thus works in conjunction with the planing that occurs at higher speeds to reduce the depth of the hull in the water, and thereby reduce drag. Accordingly, the act of planing and the additional lift from the "ram air" effect provided by air passing through the tunnels 74,76 keeps the draft of the boat hull very shallow.

Figure 11:
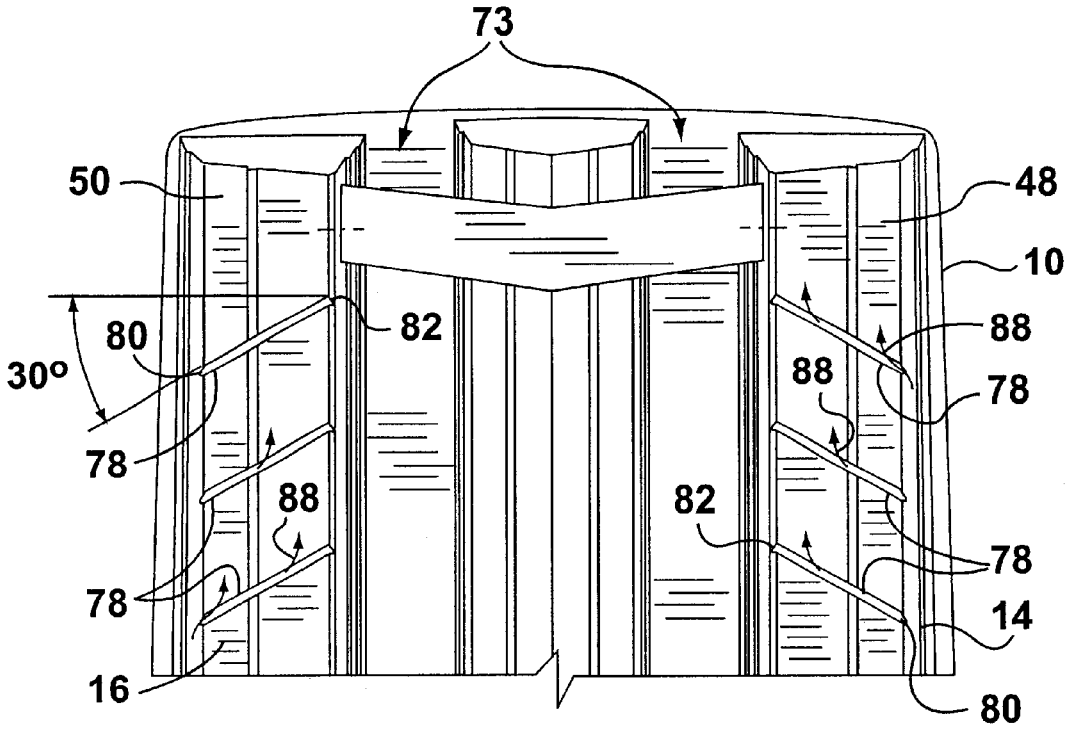
FIG. 11 is a partial bottom plan view of an aft-section of the boat hull showing optional aeration slots applied to the outer sponsons thereof.

With reference to FIG. 11, in one preferred embodiment of the invention aeration slots 78 are provided along the aft one-third of the outer sponson bottom walls 48, 50. The aeration slots 78 act as aerators to reduce friction on the major planning surface of each of the sponsons 14, 16. The slots 78 each define a respective downwardly opening passage across the sponson bottom 48, 50 that has a leading end 80 that communicates with an area outside of the hull structure and a trailing end 82 that communicates with the tunnel area 73 between the sponsons 14,16.

Figure 12:
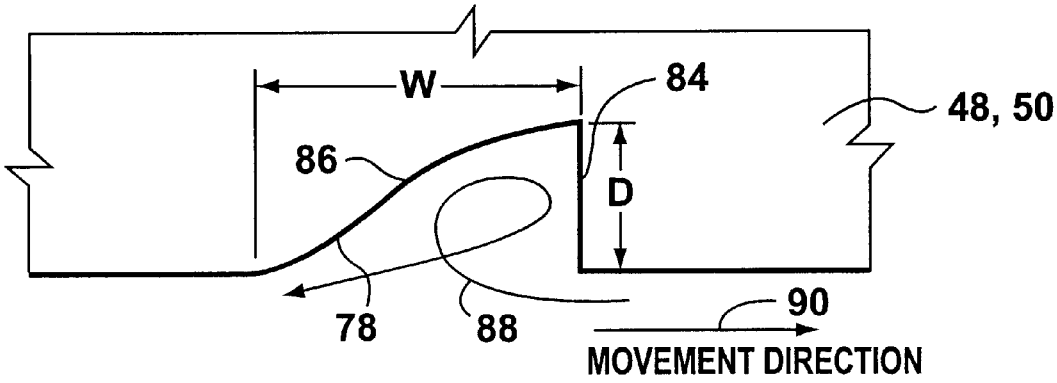
FIG. 12 is a diagrammatic partial sectional view showing an aeration slot formed on one of the outer sponsons of the boat hull of FIG. 11.

By way of example, in the embodiment illustrated in FIG. 11, the aeration slots are each angled, with the outer facing end 80 forwardly facing, at approximately 30 degrees relative to the transom of the boat, although it will be appreciated that different angles could suffice. As illustrated in FIG. 12, each aeration slot 78 preferably has a leading substantially vertically wall 84 that intersects at an upper end thereof with a curved upper and trailing wall 86. In one embodiment, the upper/trailing wall 86 has a very shallow "S" shape. When the hull 10 is planing in a forward direction as indicated by arrow 90 air, as indicated by arrows 88, is drawn in from the outboard sides of the outer sponsons and down the aeration slots towards the fast flowing air passing through the tunnel 73. The configuration of the walls 84 and 86 that define the aeration slot 78 forces much of the air out through the open bottoms of the aeration slots 72, as represented by arrows 88, and this air which escapes onto the aft planning surfaces mixes with barrier layer water and aerates the planning surfaces, thereby reducing drag. In one exemplary use, aeration slots may have a depth D of approximately 2 inches, and a width W of approximately 4 inches, however such dimensions are provided merely as an example as a range of differently dimensioned aeration slots could be used depending on the specific boat hull size and configuration.

Figure 13:
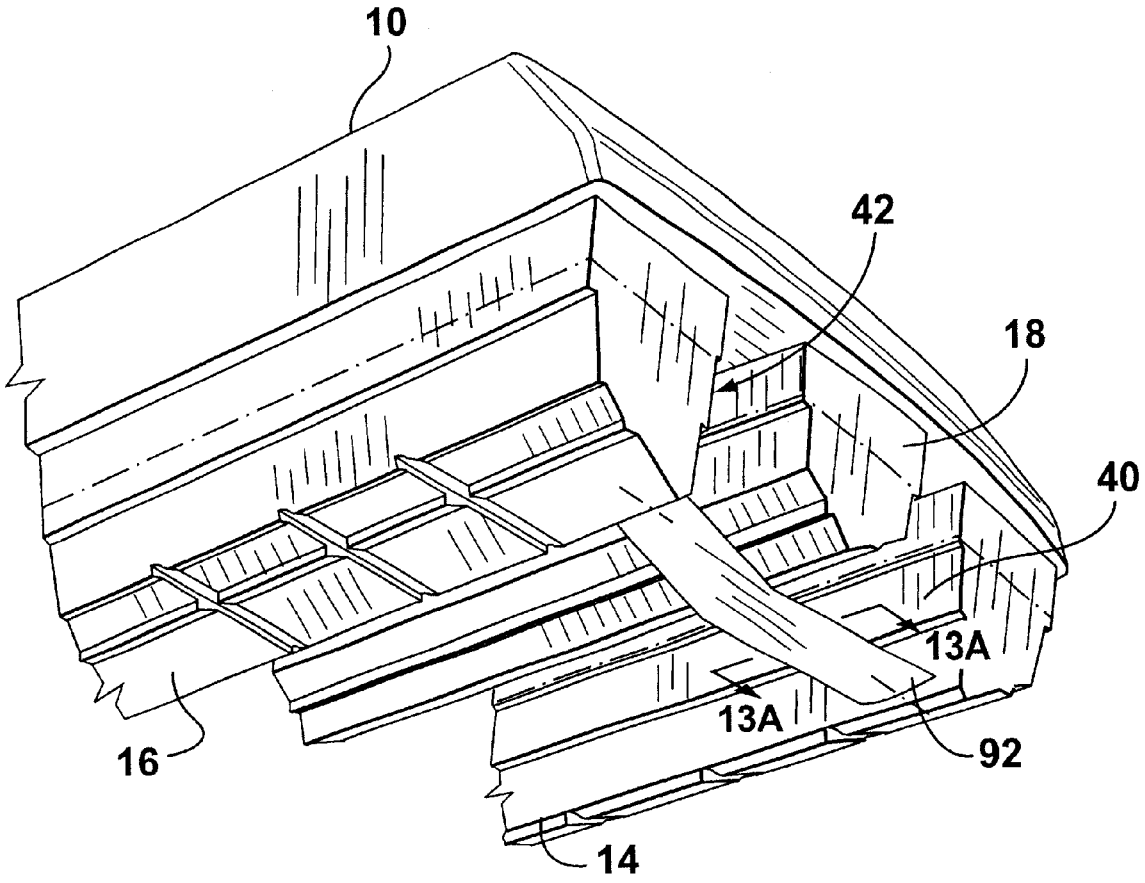
FIG. 13 is a partial perspective view of the aft-section of the boat hull showing an optional lift spoiler.
Figure 13A:
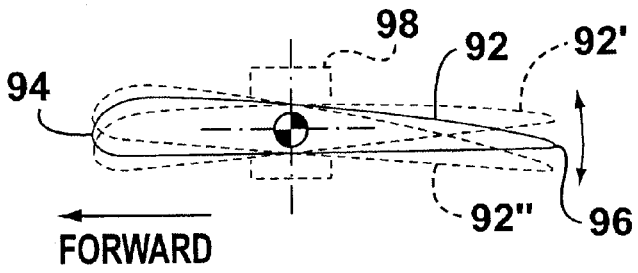
FIG. 13A is a diagrammatic sectional view taken along the lines 13A—13A of FIG. 13.

With reference to FIGS. 13 and 13A, in a preferred embodiment the boat hull 10 includes an adjustable lift spoiler 92 which is located close to the stern of the boat hull 10 and extends between the inner sides 40 and 42 of the outer sponsons 14, 16. The lift spoiler 92 preferably passes underneath the bottom of the center sponson 18 and is pivotally mounted at its opposite ends to the inner sponson walls 40, 42 such that its trim can be adjusted by means of an electrical, hydraulic or mechanical trim adjustment device 98 that is positioned in one or both of the sponsons 14 and 16 and which is controlled from a helm area of the craft into which the hull is incorporated. As indicated in FIG. 13A, the lift spoiler 92 preferably has a wing-shaped cross section with a larger forward end 94 and a tapering trailing end 96. In addition to a neutral position, the lift spoiler 92 can be pivoted so that its leading end 94 is raised relative to the horizontal as indicated by phantom line 92", or it can be adjusted so that the leading end 94 is lowered relative to the horizontal, as indicated by phantom line 92'. The trim of the lift spoiler 92 can be controlled manually from the helm so as to provide the boat operator with greater control of the trim of the hull during boat acceleration and planing. In an alternative embodiment, automatic trim control is provided for the lift spoiler, with a processing device being connected to receive information about the trim level of the hull from sensors located on the hull, and based on such signals control the trim adjustment device 98 accordingly. For example, if based on sensor input the processing device determined that the front of the boat hull has lifted up higher than a predetermined limit, the angle of the spoiler could be adjusted by the processing device to counteract against the lift and readjust the trim of the boat hull to a less steep angle. The processing device could also receive engine speed and or boat speed information to use in determining appropriate trim angle adjustments.

Figure 14:
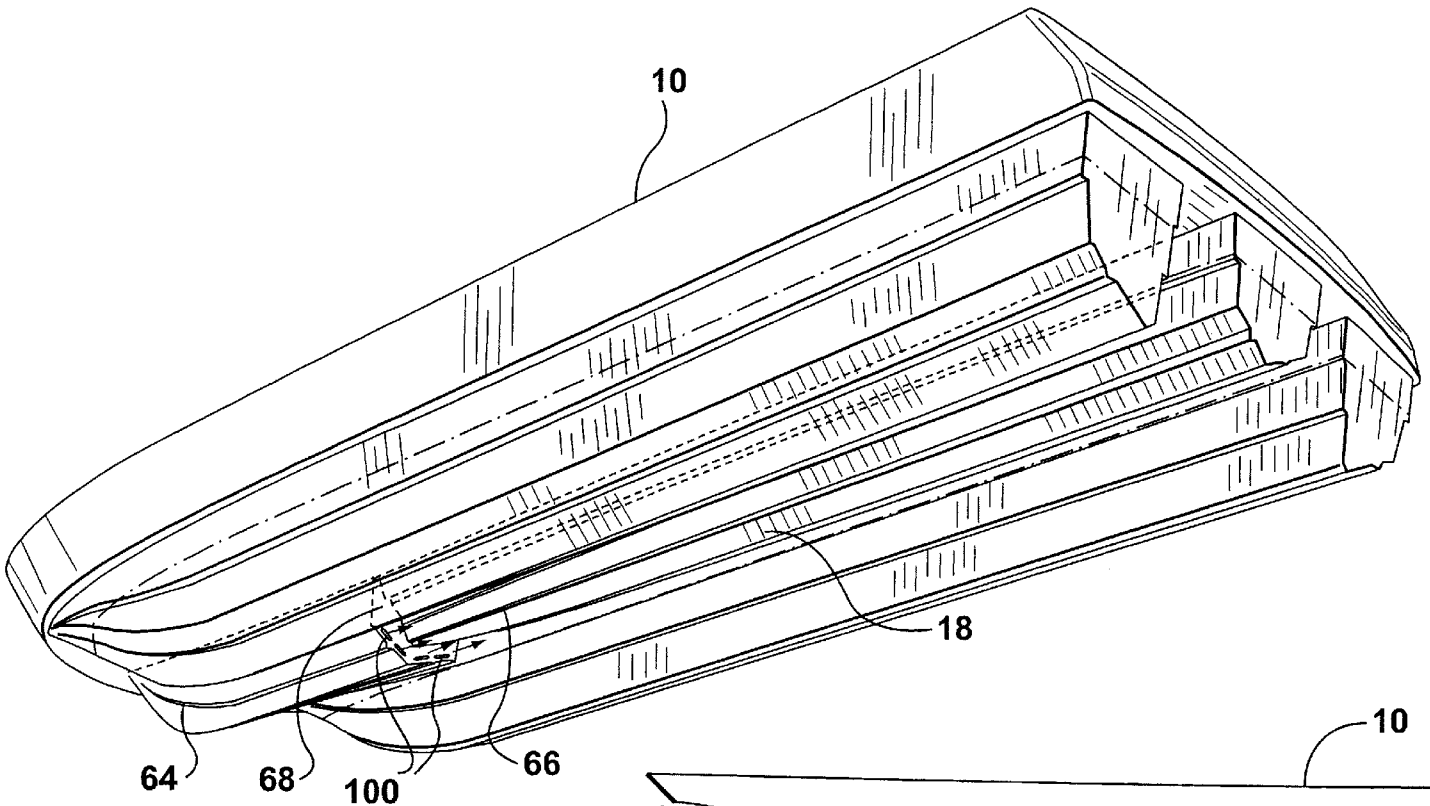
FIG. 14 is a perspective view of the boat hull showing optional aeration openings in a step in the center sponson and FIG. 14A is a diagrammatic sectional view of the boat hull showing the aeration openings and corresponding air passageways.
Figure 14A:
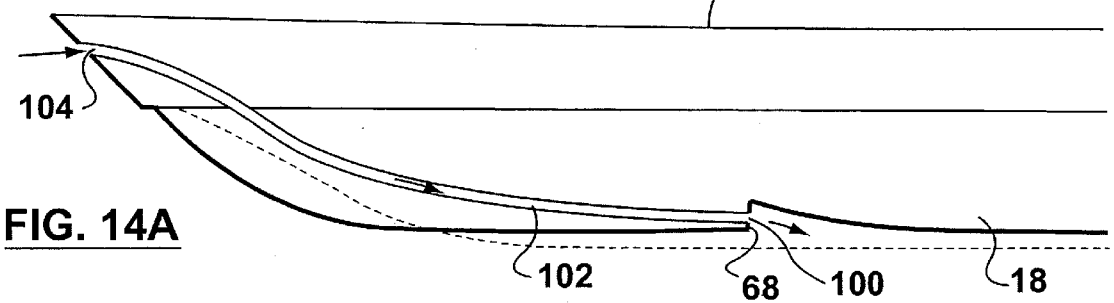

With reference to FIGS. 14 and 14A, in one embodiment of the present invention the boat hull 10 is provided with aftward facing aeration openings 100 on the step wall 68. The aeration openings 100 are connected by one or more air passageways 102 that pass internally through the hull to one or more forward facing air intake openings 104 that are located at the bow of the hull 10 above the water line. During planing, air is taken in through the intake openings 104, passes through passages 102 and exits through aeration openings 100, as indicated by the arrows in FIG. 14A, in order to reduce the drag on the aft portion 66.

The boat hull 10 can be constructed using a number of different conventional boat building materials including for example laminated layers of fibreglass in some applications, and steel or aluminum or wood in other applications. In one preferred embodiment, the outer sponsons 14,16, upper hull section 12 and center sponson 18 are each formed from a laminate structure that includes layers of Kevlar (™) reinforced glass fabrics. In particular, with reference to FIG. 15, one preferred laminate structure used to make of the sponsons and upper hull of boat hull 10 is illustrated. A surface gel coat 111 which may be an apoxy or vinylester or other suitable material is first applied to an inner surface of a mold used to make the boat hull. The outer layer 112 of the boat hull in the illustrated embodiment is a surfacing scrim-cloth or mat, which is followed by a number of laminated layers of a Kevlar(™) E-glass hybrid fabric layers 113. In the illustrated embodiment, three outer Kevlar (™)/E-glass fibre layers 113 are illustrated, however, more or fewer layers may be desired depending on the specific size and application of the corresponding boat hull. The outer laminate layers are provided over an end-grain balsa wood core 114, the inner side of which is covered by a plurality of further Kevlar (™)/E-glass fabric layers 115. Other core materials could be used in place of balsa, including for example, foams and honeycomb paper.

The next layer 116 is a Dacron (™) or similar peel ply fabric, which is followed by a breath-ply layer 117 to which an optional absorbent (bleeder) layer may be attached.

In a preferred embodiment, the Kevlar (™)/E-glass fabrics are pre-impregnated with "B" staged epoxy resin such that the laminated layers can be thermally cured at approximately 250–275 degrees ferenheit. The laminate structure is layered up on a mold with the surface gel coat 111 being applied to the mold surface, and then the subsequent layers laid up in the order shown in FIG. 15 and described above. Once layered up, a vacuum bagging film 118 having multiple vacuum fittings 119 positioned therein is placed over the entire inner structure of the laminated materials in order to compress the laminate structure against the mold in the direction indicated by arrows 120 when air is evacuated through fittings 119 as indicated by arrow 122. Vacuum compression will typically compact the laminate during heat curing.

Figure 16:
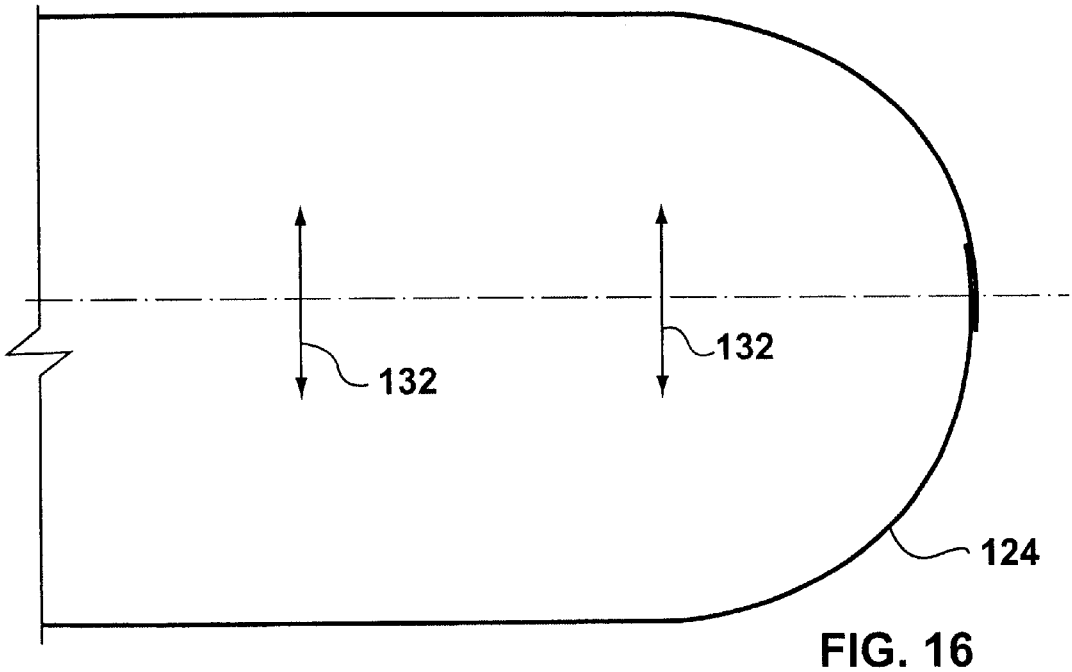
FIG. 16 is a partial plan view of a mold used to make an upper hull portion of the boat hull.
Figure 17:
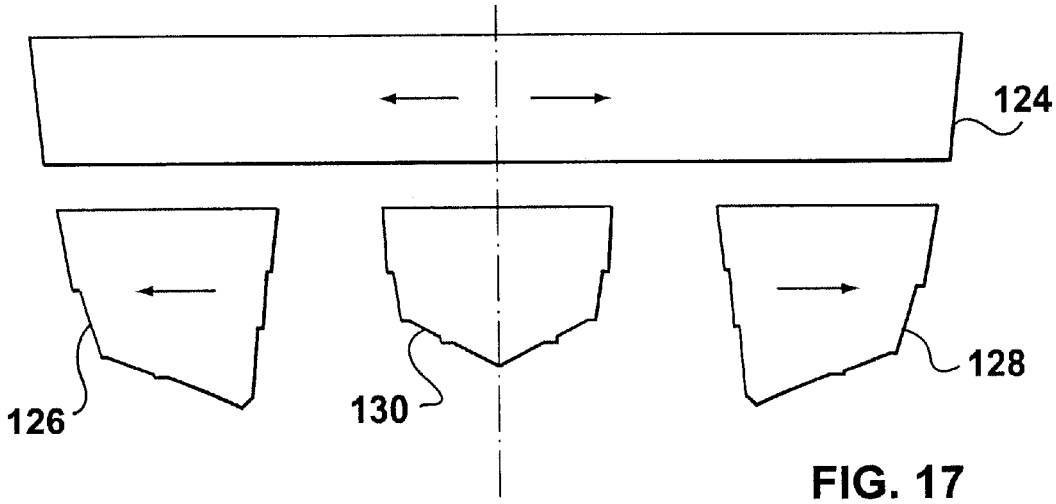
FIG. 17 is a diagrammatic aft-end view illustrating construction of the boat hull.

In the laminated fibre construction method, each of the hull components, namely upper hull section 12, outer sponsons 14,16 and center sponson 18 are each preferably layered up separately using different molds, and in this respect FIGS. 16 and 17 illustrate representative molds 124, 126, 128 and 130, each of which is used for a separate corresponding component 12, 14, 16 and 18 of the boat hull 10. Once each of the separate components have been layed up, vacuum compressed, and heat cured, their respective molds are subsequently assembled together after which further layers of Kevlar (™)/E-glass layers are used to secure the joints between each of the outer sponsons and the center sponson laminated portions adjoining them to the upper hull section 12. Alternatively, the four component molds (outer sponsons, center sponson, and upper hull section) can be assembled together and then layed up and heat cured together, rather than separately.

The use of separate molds, which varies from traditional boat hull construction in which the boat hull is molded as a unified structure, provides versatility in that the same molds in manufacturing process can be used to make boat hulls of a wide range of sizes. In particular, upper boat hull mold section 124 preferably has an adjustable width as indicated by lines 132 in FIG. 16, and also an adjustable length, and the sponson molds 126, 128 and 130 each preferably have an adjustable length. For larger hull designs, the sponsons 126 and 128 can be spaced further apart, or can be spaced closer together for narrower hull designs. The flat underbody of the upper hull section 12 provides a design which is very ameniable to adjustment for different boat sizes as the top of the tunnel remains planer regardless of the relative positions of the outer sponsons. Because of the flat underbody, the relative position of the outer sponsons can easily be changed for different boat hull sizes to optimize the tunnel dimensions for a specific hull size and ram-air effect. Based on the desired speeds and load carry capability of the craft that incorporates the boat hull, an optimum sponson placement can be determined. Thus with the flat-bottom underbody and separate mold system described herein, using the same molds, different boat hulls having the same size can be made having different outer sponson placement locations to account for different intended uses of the boat hulls.

The Kevlar(™)/E-glass hybrid fibre layers may made of materials that are commercially available from Martintek of St. Jean sur Richelieur, Quebec including for example Martintek (™) product numbers 9009-127 single weave; product number 9037-127 double weave; or product number 9032-127 double weave, double weight fabrics. The Kevlar (™)/E-glass fabrics are preferably pre-impregnated with heat curable "B" staged epoxy resin, rolled and then placed in frozen storage until used to lay up the boat hull. Using heat curable "B" staged epoxy resin impregnated fabrics for the lamination process allows the lamination process to start and stop at will for several days without curing taking place, as opposed to traditional wet epoxy on site impregnation systems in which curing can occur within a few hours. Wet-catalyst curing systems typically require that the resin be applied to the fibre layers at the location that the boat is being made, thus introducing several subjective factors into the hull building process. Conversely, pre-impregnated thermal curing systems allow fabrics to be pre-impregnated in a highly-controlled process, thus resulting in a real-life production scenario in which consistent quality can be maintained, thus minimizing the need to design-in the redundancy (and hence excess weight) normally required in wet-curing systems.

The preferred composite materials described provide a lightweight, very strong hull which can be consistently produced in a high quality manner. It will be appreciated that this lightweight, strong design is particularly advantageous when used with the tri-sponson design described herein. However, such composite material construction could also be advantageously applied to other boat hull configurations including catamaran and single-hull designs.

It will be appreciated that a number of features of the present invention have been set out above and that not all embodiments of the present invention need include every feature set out above. The design provided by the present invention provides a great deal of versatility and can be applied to a large range of boat hull sizes from small pleasure craft to larger vessels such as coastal-patrol vessels.

Figure 15:
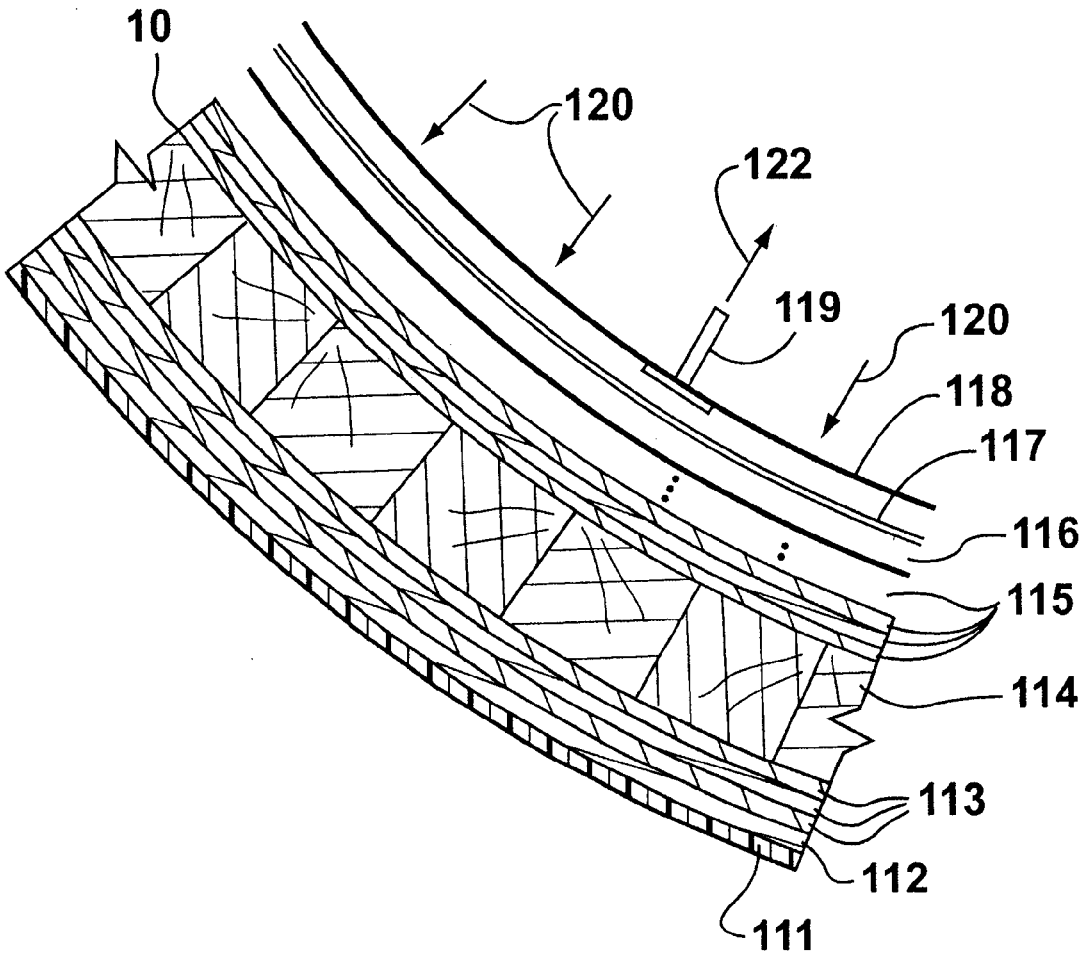
FIG. 15 is a partial sectional view showing the laminate construction of the boat hull in accordance with a preferred embodiment of the invention.

When the laminate composite structure shown in FIG. 15 is used in the construction of the present boat, the compensate structure provides a very low radar signature. Angulation of the deck applied to the hull and use of radar absorbing paints can still significantly reduce the signature of boats which incorporate the boat hull of the present invention, as can engine shielding materials. Engine exhaust could be cooled by redirecting sea water through the water jacket, substantially reducing any heat signature. The use of jet drives (using an impeller to take water in and force it out the aft end of one more of the sponsons) could also be used in conjunction with a hull to vastly reduce sonar signals. Balistic Kevlar (™) could be molded onto the inside of the current composite structure to provide small arms fire protection.

Various features of the invention are set forth in the following claims.

What is claimed is:

1. A boat hull having a bow and a stern, comprising:

an upper hull section;

a pair of spaced apart substantially parallel elongated outer sponsons extending from a forward portion to a stern portion of a bottom of the upper hull section, the outer sponsons and upper hull section defining a tunnel therebetween; and an elongated center sponson extending along the bottom of the upper hull and positioned in the tunnel between and substantially parallel to the pair of outer sponsons and having a forward section with an upwardly extending trailing step wall defining an upward step in the center sponson, and an aft section that is located aft of the forward section, the aft section having a leading edge that curves upward in a forward direction and intersects the step wall of the forward section.

2. The boat hull of claim 1 wherein the outer sponsons and the forward section of the center sponson each have an upwardly curved leading edge, the center sponson being of lesser depth than the outer sponsons.

3. The boat hull of claim 2 wherein the leading edge of the forward section of the center sponson extends further forward than the leading edges of the outer sponsons.

4. The boat hull of claim 3 wherein the aft section includes a pair of opposing side walls that converge in a forward direction approaching the step wall, the upwardly curved leading edge of the aft section being located at a bottom portion of the opposing side walls approaching the step wall.

5. The boat hull of claim 3 wherein the forward section includes a pair of opposing sidewalls having deadrise angles that become shallower in an aft-ward direction.

6. The boat hull of claim 3 wherein the center sponson extends further aft than the outer sponsons.

7. The boat hull of claim 3 wherein a maximum depth of the forward section of the center sponson is greater than a maximum depth of the aft section.

8. The boat hull of claim 7 wherein the maximum depth of the forward section occurs close to the step wall.

9. The boat hull of claim 7 wherein the step wall is approximately ⅓ of the length of the boat hull back from a front of the bow of the boat hull.

10. The boat hull of claim 3 wherein aft of the leading edge thereof, a bottom of the aft section of the center sponson is substantially parallel to the bottom of the upper hull section.

11. The boat hull of claim 1 wherein an above water line air inlet is located in a forward portion of the boat hull and an air passage way is provided from the air inlet to at least one aft facing aeration outlet provided on the step wall for providing aeration to the leading edge of the aft section of the center sponson.

12. The boat hull of claim 1 wherein the aft and forward sections of the center sponson each include elongate sides meeting at a bottom edge and diverging upwardly outward, the angle of divergence of the sides of the forward section being less than the angle of divergence of the aft section.

13. The boat hull of claim 1 wherein the aft section of the center sponson includes elongate sides meeting at a bottom edge and diverging upwardly outward, the angle of divergence increasing from forward to aftward along a portion of the length of the aft section.

14. The boat hull of claim 1 wherein the bottom of the upper hull is substantially planar.

15. A boat hull having a bow and a stern, the hull comprising:

an upper hull section;

a pair of spaced apart substantially parallel elongated outer sponsons extending from a forward portion to a stern portion of a bottom of the upper hull section, the outer sponsons and upper hull section defining a tunnel therebetween, the outer sponsons each having an inner wall extending substantially perpendicular to a water line, an outer chine and a bottom wall joining bottom edges of the inner wall and the outer chine, the bottom wall being substantially planar aft of a leading edge thereof and angled upwardly from the inner wall to the outer chine, the upward angle of the bottom wall relative to the water line being less than that of the outer chine; and an elongated center sponson extending along the bottom of the upper hull and positioned in the tunnel between and substantially parallel to the pair of outer sponsons, the center sponson extending forwardly of the outer sponsons and having a upward step along its length with a portion of the center sponson leading the step having a greater depth than a portion of the center portion aft of the step, the center sponson being of lesser depth than the outer sponsons.

16. The boat hull of claim 15 wherein aeration slots are formed across the bottom wall of each of the outer sponsons, the slots each having downwardly opening passage having a leading end communicating with an area outside of the tunnel and a trailing end communicating with the tunnel.

17. The boat hull of claim 15 wherein the aeration slots are formed across portions of the bottom walls on which the outer sponsons plane when the boat hull moves at planing speeds.

18. The boat hull of claim 15 wherein the bottom and inner walls of each of the sponsons are joined by an inwardly upward angled comer portion.

19. The boat hull of claim 18 wherein the comer portion is angled at approximately 45 degrees.

20. The boat hull of claim 15 wherein the outer sponsons, center sponson and upper hull are each formed from laminated layers, at least some of which include blended Kevlar and E-glass fabric.

21. The boat hull of claim 15 wherein a wing-shaped lift spoiler is pivotally mounted between the inner walls of the pair of outer sponsons, the spoiler passing beneath an aft section of the center sponson and being adjustable to control trim of the boat hull during use.

22. The boat hull of claim 15 wherein an above water line air inlet is located in a forward portion of the boat hull and an air passage way is provided from the air inlet to at least one aft facing aeration outlet provided on the step for providing aeration to center sponson behind the step.

23. A boat hull having a bow and a stern, the hull comprising:

an upper hull section;

a pair of spaced apart substantially parallel elongated outer sponsons extending from a forward portion to a stem portion of a bottom of the upper hull section, the outer sponsons and upper hull section defining a tunnel therebetween;

an elongated center sponson extending along the bottom of the upper hull section and positioned in the tunnel between and substantially parallel to the pair of outer sponsons; and a wing-shaped lift spoiler pivotally mounted between the pair of outer sponsons, the spoiler passing beneath an aft section of the center sponson and being adjustable to control trim of the boat hull during use.

24. The boat hull of claim 23 including means for sensing a position of the hull and automatically adjusting the trim of the spoiler based on the sensed hull position.

25. A method of making a tri-sponson boat hull comprising:

forming from reinforced fibre material, using an upper hull mold, an upper hull section having a substantially planar underbody;

forming from reinforced fibre material, using first and second outer sponson molds, an elongated first outer sponson and an elongated second outer sponson;

forming from reinforced fibre material, using a center sponson mold, an elongated center sponson;

arranging the upper hull section, first and second outer sponsons and the center sponson such that the first and second outer sponsons extend from a forward section to a stem portion of the underbody of the upper hull section, the outer sponsons and underbody defining a tunnel therebetween, and the center sponson extends along the underbody of the upper hull and is positioned in the tunnel between and substantially parallel to the first and second outer sponsons; and securing the outer sponsons and center sponson to the upper hull using reinforced fibre material.

26. The method of claim 25 wherein the steps of forming the upper hull section, forming the first outer and second outer sponsons and forming the center sponson include layering up on the upper hull mold, the first and second outer sponson molds, and the center sponson mold, respectively, blended Kevlar and E-glass woven fabrics that are preimpregnated with heat curable epoxy resin; and the method further includes heat curing the layered fabrics.

27. The method of claim 26 wherein the layered fabrics are heat cured at approximately 250–275 degrees Fahrenheit.

28. The method of claim 26 wherein the layered fabrics are compacted during heat curing.

* * * * *